US006209616B1

(12) United States Patent
Polich

(10) Patent No.: US 6,209,616 B1
(45) **Date of Patent: *Apr. 3, 2001**

(54) VACUUM-ASSISTED, GRAVITY-FED CASTING APPARATUS AND METHOD

(76) Inventor: Richard F. Polich, 39 Lakeview Trail, Salisbury Mills, NY (US) 12577

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/100,622

(22) Filed: Jun. 19, 1998

Related U.S. Application Data

(60) Provisional application No. 60/050,386, filed on Jun. 20, 1997.

(51) Int. Cl.[7] ..... B22C 25/00; B22D 27/15

(52) U.S. Cl. ..... 164/5; 164/65; 164/255

(58) Field of Search ..... 164/63, 65, 255, 164/131, 5

(56) References Cited

U.S. PATENT DOCUMENTS

| | | | | |
|---|---|---|---|---|
| 1,756,812 | * | 4/1930 | Camerota | 164/131 |
| 3,780,787 | * | 12/1973 | Rasmussen | 164/65 |
| 3,863,706 | | 2/1975 | Chadley et al. | 164/255 |
| 3,900,064 | | 8/1975 | Chandley et al. | 164/51 |
| 4,112,997 | | 9/1978 | Chandley et al. | 164/119 |

FOREIGN PATENT DOCUMENTS

| | | | | |
|---|---|---|---|---|
| 60-3959 | * | 1/1985 | (JP) | 164/65 |
| 61-180642 | * | 8/1986 | (JP) | 164/63 |
| 3-8547 | * | 1/1991 | (JP) | 164/63 |
| 3-8550 | * | 1/1991 | (JP) | 164/63 |
| 5-192762 | * | 8/1993 | (JP) | 164/131 |
| 6-226422 | * | 8/1994 | (JP) | 164/65 |
| 1178794 | * | 9/1985 | (RU) | 164/131 |
| 1235651 | * | 6/1986 | (RU) | 164/131 |

OTHER PUBLICATIONS

Advertisement: Shidoni and Ransom & Randolph, "Creating a Monumental Difference in Fine Art" Dupont Ludox® colloidal silica, "Ceramic Shell Investment Casting with Ludox®", Oct. 1996 Graph: Fired Strength Versus Time Between Dips.

* cited by examiner

*Primary Examiner*—Kuang Y. Lin
(74) *Attorney, Agent, or Firm*—Fish & Neave; Jeffrey H. Ingerman

(57) ABSTRACT

This invention relates to metal casting apparatus, methods and molds and more particularly to the casting of metal in refractory, gas-permeable, shell-type molds which are lighter and have thinner wall thicknesses than the refractory, gas-permeable, shell-type molds commonly used in the ceramic shell casting process for lost wax casting of ferrous and nonferrous alloys such as steel, aluminum, and bronze. As a result of the use of vacuum in the inventive apparatus and method, more complete mold fill out is achieved, resulting in better capture of exact detail and close tolerances in the finished cast object. Further advantage is derived from the fact that the casting of large objects is simplified and can be done more quickly. Also, there is an associated substantial savings in labor costs, materials costs and time. The inventive apparatus and method also can be used in the foam vaporization casting process of metal casting.

67 Claims, 1 Drawing Sheet

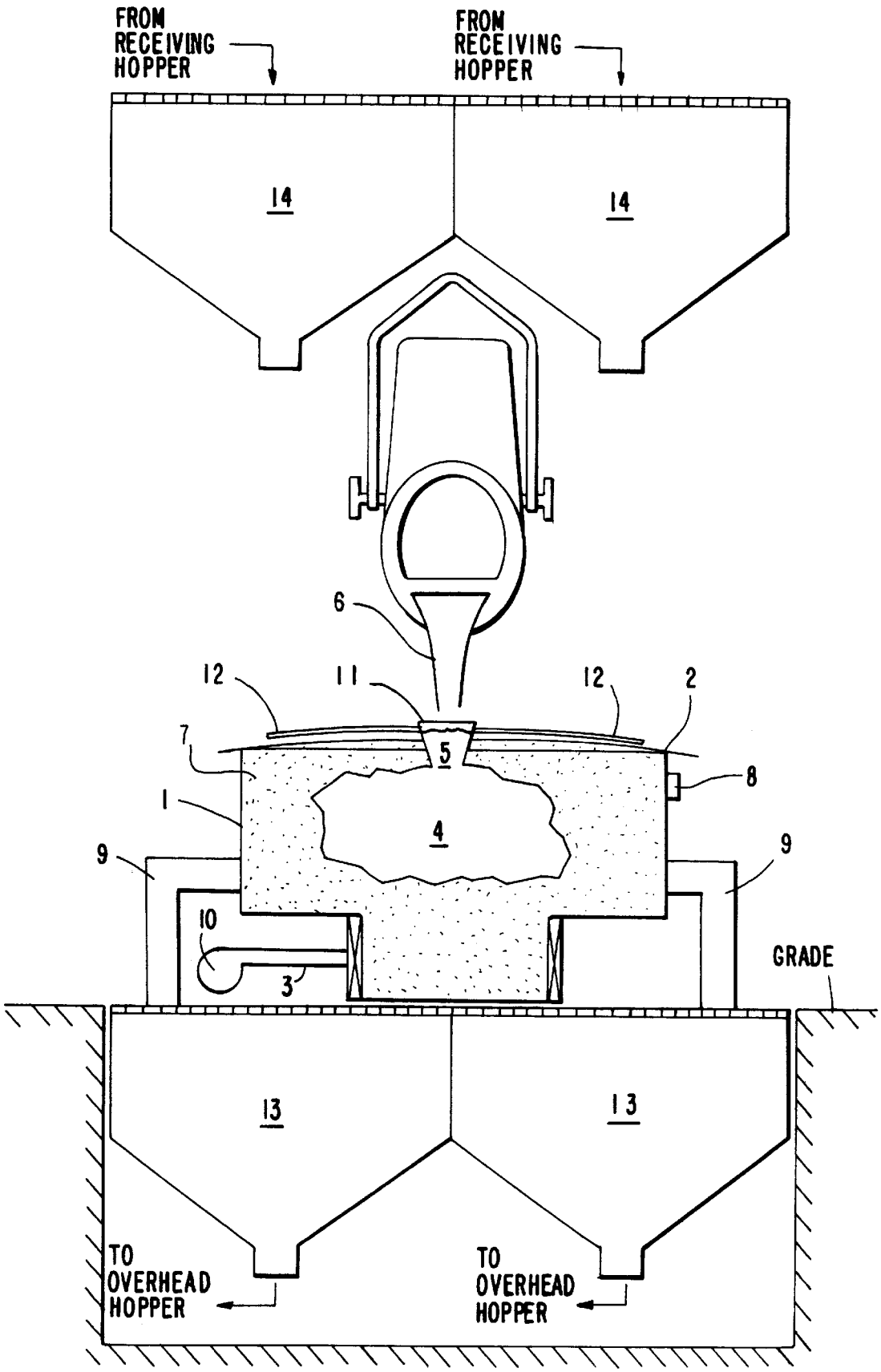
FROM RECEIVING HOPPER
FROM RECEIVING HOPPER
14
14
6
12
11
12
2
7
5
8
1
4
9
9
10
3
GRADE
13
13
TO OVERHEAD HOPPER
TO OVERHEAD HOPPER

VACUUM-ASSISTED, GRAVITY-FED CASTING APPARATUS AND METHOD

CROSS REFERENCE TO RELATED APPLICATION

This claims the benefit of U.S. Provisional Application No. 60/050,386, filed Jun. 20, 1997.

BACKGROUND OF THE INVENTION

This invention relates to metal casting apparatus, methods and molds and more particularly to the casting of metal in refractory, gas-permeable, shell-type molds which are lighter and have thinner wall thicknesses than the refractory, gas-permeable, shell-type molds commonly used in the ceramic shell casting process for lost wax casting of ferrous and nonferrous alloys such as steel, aluminum, and bronze.

Conventionally used refractory, gas-permeable, shell-type molds are made of multiple layers of ceramic slurry and sand. Thick-walled molds, consisting of upwards of 30 or more layers, are known in the industry. The ability to use lighter and thinner-walled molds (on the order of 5–8 layers or less) would be advantageous from both a cost and labor standpoint, especially when it is understood that these molds typically cannot be reused. Once a metal object has been cast in a mold, the mold is torn away from the cast metal object and discarded.

Traditionally used thick-walled refractory, gas-permeable, shell-type molds suffer functional disadvantage resulting from the fact that the molds have measurable but slight permeability. This characteristically low permeability prevents the mold cavity from filling out with molten metal in heavily detailed sections and in sections having large surface areas relative to volume because of entrapped air that cannot permeate out through the mold walls before the molten metal solidifies. Accordingly, it is desirable to use molds that yield more complete fill out of the mold cavities resulting in better capture of exact detail and close tolerances.

In the conventional ceramic shell casting process, it is possible to use one large mold cavity with a runner or runners that feed molten metal directly into the mold cavity. Alternatively, many smaller mold cavities can be connected to a main, central runner by feeder tubes commonly known as ingates. In instances where molten metal is fed in the vertical plane, the runner is commonly referred to as a down sprue. (The molten metal is poured through one or more pouring basins which in turn feed the molten metal into one or more down sprues.)

When large molds are being used, or when many molds are ganged along a runner or down sprue, molten metal may solidify before it completely fills the molds. This problem of non-fill can be solved by increasing the number of down sprues or ingates feeding each of the molds or by increasing the pouring temperature of the molten metal. Neither of these solutions is optimal. Using greater numbers of down sprues and ingates results in the need for additional retooling of the finished cast object in order to remove surface artifacts left by the down sprues or ingates with a commensurate increase in associated labor costs. An increased pouring temperature is undesirable because excess superheat can lead to very deleterious effects on the mechanical and structural properties of the finished cast objects including greater likelihood of void formation, microcracks, gross cracks and metal segregation.

Another problem associated with conventional ceramic shell casting processes resides in the fact that, when a mold cavity fills with molten metal, the pressure of the metallostatic head wants to burst the mold open. This is a common problem in the industry and there have been attempts to solve it by:

1. sinking the mold into a fluidized bed of sand (as molds get bigger and vertically higher, the more the sand covering the mold must weigh to offset the metallostatic head which wants to burst the mold open);
2. making the walls of the molds very thick (one known method uses 30 or more coats of ceramic slurry and sand to make the shell of the mold);
3. reinforcing the mold by building wire into the mold; or
4. reinforcing the mold by adhering wire to the outside of the mold with refractory cement.

None of these methods is completely successful.

One method meeting with an additional degree of success for solving this mold rupture problem is a known vacuum casting method substantially described in U.S. Pat. No. 3,900,064 and using molds substantially as described therein and in U.S. Pat. No. 4,112,997. However, this known vacuum casting method is not completely successful either. According to that method, the mold is placed in a vacuum chamber and the entire vacuum chamber is suspended above a source of molten metal. A down sprue extends down into the molten metal. Vacuum is applied to the vacuum chamber, drawing metal into the mold through the down sprue. However, such a system which uses a mold in a vacuum chamber suspended over a molten metal source is constrained in the size castings that can be made due to a number of limitations.

The first limitation is the necessity to have a vacuum chamber large enough to enclose the mold. Very large vacuum chambers can be built to enclose large molds, but with difficulty.

The second limitation is even more difficult to overcome and is explained by comparison to conventional ceramic shell casting processes which do not employ vacuum. As explained above, in conventional ceramic shell casting processes, non-fill can be a problem when large molds are used or when many molds are ganged along a runner or down sprue. Attempts to remedy the non-fill problem, as explained above, include increasing the pouring temperature of the molten metal or using additional down sprues and ingates. In the known vacuum casting method, non-fill likewise can be a problem. Increasing the pouring temperature of the molten metal is an unacceptable solution because it can result in mechanical and structural defects as described previously. Furthermore, the use of multiple down sprues, as in the conventional ceramic shell casting processes, is difficult if not impossible to implement. This is because each down sprue is a ceramic tube which protrudes about 12–16 inches below the bottom of the vacuum chamber, and must pass through the wall of the vacuum chamber and connect to the mold in the vacuum chamber. This connection is complicated, requiring unerring precision, for molten metal will leak through the smallest hole. To locate multiple down sprues in a single chamber with the required level of precision would be difficult if not impossible. Furthermore, the labor costs associated with the achievement of such precision would be substantial.

There is no way to overcome the third problem associated with the known vacuum casting method. Using 14.7 psi as atmospheric pressure and taking 304 stainless steel as an example of the alloy being cast, one can quickly determine a maximum limit for how vertically high a casting can be made. The density of 304 stainless steel is about 0.28 $lb/in^3$. At a pressure of zero in the chamber, the maximum column of metal that can be supported is 14.7÷0.28 or about 52 inches. Of course, safety factors and practical considerations (e.g., one cannot realistically attain zero pressure) would result in a decrease of that number by at least about 20%.

The final limitation of the known vacuum casting method is that the entire vacuum chamber, with the down sprue protruding out of the bottom of the vacuum chamber, must be lifted and moved to the molten metal. And for large castings, the vacuum chamber must be held suspended over the molten metal, with the vacuum on, until the metal solidifies. (This solidification time is at least three to five minutes, depending on the alloy being cast.) Otherwise, as a result of gravity, the unsolidified metal will drain out of the mold cavity and back into the crucible which holds the molten metal. This can result in defects in the cast metal objects. The molds described in U.S. Pat. No. 4,112,997 represent an attempt to alleviate this problem.

SUMMARY OF THE INVENTION

Accordingly it is an object of the present invention to ensure that both large and small castings can be made with thin-walled, refractory, gas-permeable, shell-type molds (about 5 to about 8 layers thick or less), thereby producing great savings in labor, materials and reduced scrap, as well as simplifying the casting of large objects.

It is another object of this invention to ensure that the mold cavities sufficiently fill out with molten metal in heavily detailed sections and in sections having large surface areas relative to volume thereby providing greater detail and more faithful reproduction in the finished cast objects.

It is another object of this invention to minimize non-fill of mold cavities.

It is another object of this invention to ensure that large and small castings can be made using a minimum number of down sprues and ingates, resulting in savings in labor and materials, as well as simplifying the casting process.

It is another object of this invention to speed up the cycle time for the making of cast metal objects in part as a result of not being constrained by any need to wait for the molten metal to solidify in the mold prior to release of the vacuum.

It is another object of the invention to reduce or substantially eliminate oxidation and decarburization and/or impart a color to the surface of the metal objects being cast via the use of certain additives.

It is another object of this invention to permit the casting of foam objects in unbonded sand. Here the vacuum will give extra stability to dimensions and permit the casting of objects larger than those currently being cast in the known evaporative foam process.

In accordance with this invention, there is provided a pouring chamber. The pouring chamber accommodates one or more refractory, gas-permeable, shell-type molds made of one or more layers of ceramic slurry and sand.

The refractory, gas-permeable, shell-type molds can comprise a single mold cavity or many mold cavities connected via ingates to one or more runners or down sprues. Each refractory, gas-permeable, shell-type mold contains one or more pouring basins through which molten metal will be poured into the mold cavity, either directly or via the system of down sprues, runners and ingates.

In practice, each refractory, gas-permeable shell-type mold, including any of the mold's associated ingates, runners, down sprues and pouring basins, is first preheated, preferably in an oven. (The preheat temperature depends on the metal being cast.) The preheated mold, including any of the mold's associated ingates, runners, down sprues and pouring basins, is then placed into the pouring chamber. The pouring chamber is then filled with a packing material, such as loose, unbonded sand, leaving only the pouring basin protruding out of the packing material. By unbonded it is meant that the sand contains no binding agents such as clay, urethane or other resins.

It is preferred that prior to filling the pouring chamber with the packing material the pouring basins are temporarily covered with caps made of metal or pieces of foil to keep the packing material or other foreign objects from entering the pouring basins. Once the mold is buried by the packing material, a vibrator may be used to pack the packing material. As the vibrator packs the packing material, it may become necessary to add additional packing material to ensure that the mold is sufficiently covered with the packing material. The whole pouring chamber is then covered with a substantially gas-impermeable covering such as a polyethylene sheet, rubber blanket, sheet metal or other material. If the covering is a material such as rubber that is amenable to melting, the preheated pouring basins will in turn heat up the cap or foil covering the pouring basin and melt a hole through the substantially gas-impermeable covering, thus exposing the pouring basin through which molten metal will be poured. Otherwise the substantially gas-impermeable covering is cut to expose the pouring basin.

Optionally, sheets of metal or other material may be positioned on top of the substantially gas-impermeable covering to serve as splash guards when the molten metal is poured into the pouring basins. A quantity of the packing material deposited on top of the substantially gas-impermeable covering likewise can serve as a splash guard. The splash guards serve additional advantage in that they also can function to hold the substantially gas-impermeable covering in place, especially around the edges of the covering.

As the molten metal is poured into the mold cavity via the pouring basin and any associated runners, down sprues and ingates, a vacuum pump is turned on, and air is drawn out via an evacuation pipe located on the pouring chamber. As a result, the substantially gas-impermeable covering is pressed down by atmospheric pressure to form a seal over the pouring chamber. The packing material under the substantially gas-impermeable covering also becomes very hard as atmospheric pressure pushes down onto the packing material. The hardened packing material supports the mold and aids in the prevention of mold failure, mold deformation and leaks. Furthermore, as a result of the vacuum, entrapped air is drawn out of the mold through its gas permeable walls. The evacuation of the entrapped air makes for more complete fill-out of the mold with molten metal and accordingly makes possible the capture of exact detail and close tolerances in the cast object.

In the present invention, the pouring chamber is stationary and gravity, in addition to the vacuum, is used to draw the molten metal into the mold. Because gravity assists in drawing the molten metal into the mold, it is not necessary to wait for the molten metal to solidify prior to release of the vacuum. This gravity assist greatly speeds the process cycle time. After the molten metal is poured, the vacuum can be turned off, the pouring chamber emptied of packing material through ports in the bottom of the pouring chamber, and the pouring chamber readied for the next casting, all in a 3–4 minute total cycle time. The sand emptied from the pouring chamber may be received in one or more hoppers and reused in the next casting cycle. The hoppers may be subgrade in that they may be located beneath the pouring chamber.

Oxidation of the surface of the final cast object may be reduced or substantially eliminated as a result of the addition of hexamine to the packing material. Surface oxidation also may be reduced by supplying an argon gas bath over the packing material. When vacuum is applied, the vacuum draws the argon gas down into the packing material, displacing any oxygen that may be present.

The inventive method and apparatus likewise can be used in the known foam vaporization process of casting. The process and equipment used is substantially as described above, with the exception that there is no system of refractory, gas-permeable, shell-type molds. Rather, the form of the object to be cast in metal, the down sprues, the runners and the ingates are blown or carved or otherwise fashioned from a foam material such as foamed polystyrene or STYROFOAM®, a product available from the Dow Chemical Company. As such, the form of the object to be cast in metal, the down sprues, the runners and the ingates are solid foam material. A pouring basin is attached to the foam runner, foam down sprue or directly to the foam form of the object to be cast in metal. When molten metal is poured into the pouring basin, it causes the foam to vaporize and become gaseous. The pressure of the gas maintains cavities in the packing material in the shape of the original foam long enough for the molten metal to supplant the gas in those cavities and solidify in the shape of the original, but since vaporized, foam.

The use of vacuum provides added support and stability for the foam as a result of the hardening of the packing material around the foam. The vacuum also aids in ensuring the capture of fine detail and close tolerances in the cast object as a result of the fact that the vacuum assists in drawing the metal into the gaseous cavities created by the evaporation of the foam. Accordingly, larger and more detailed objects can be cast as a result of the inventive method and apparatus. Finally, the vacuum aids in disposal of gasses generated by the foam as it vaporizes during casting.

BRIEF DESCRIPTION OF THE DRAWING

The above and other objects and advantages of the invention will be apparent upon consideration of the following detailed description, taken in conjunction with the accompanying FIGURE, which is an elevational view, partially in section, of a preferred embodiment of a vacuum-assisted, gravity-fed casting apparatus according to this invention.

DETAILED DESCRIPTION OF THE INVENTION

The apparatus and method of the invention is diagramed and described with reference to the FIGURE. The apparatus comprises a pouring chamber 1, the top of which is sealed by a substantially gas-impermeable covering 2 such as a polyethylene sheet, rubber blanket, sheet metal or other material which will be pressed down by atmospheric pressure to make a seal when a vacuum is drawn via a vacuum pump 10 attached to evacuation pipe 3 on the pouring chamber 1.

The pouring chamber 1 accommodates one or more forms 4, which may be refractory, gas-permeable, shell-type molds or foam forms of the objects to be cast in metal. The refractory, gas-permeable, shell-type molds are similar to those used in the traditional ceramic shell casting process in that they are made of layers of ceramic slurry and sand. In the case of either foam forms or refractory, gas-permeable, shell-type molds, the forms 4 are connected to one or more pouring basins 5 through which molten metal 6 will be poured. The forms 4 can comprise a single form or many forms connected via ingates (not shown) to one or more runners or down sprues (not shown). However, one of the advantages of the inventive method is that when the form 4 is a refractory, gas-permeable, shell-type mold, the mold walls can be very thin (as few as about 5–8 coats, and possibly even fewer coats, of ceramic slurry and sand). If desired, the mold walls can be made from more than 8 coats of ceramic slurry and sand.

According to the invention, when the form 4 is a refractory, gas-permeable, shell-type mold, it and its associated runners, down sprues, ingates and pouring basins 5, are first preheated, preferably in an oven (not shown). The preheat temperature depends on the metal being cast. In the case of aluminum, the preheat temperature is between about 400° F. and about 1000° F.; in the case of bronze, the preheat temperature is between about 800° F. and about 1400° F.; in the case of steel, the preheat temperature is between about 1750° F. and about 2000° F.

The form 4, being either foam or the preheated refractory, gas-permeable, shell-type mold is then placed into the pouring chamber 1. The form 4 is then covered with a packing material 7 such as loose, unbonded sand, leaving only the pouring basin 5 protruding out of the packing material 7.

Oxidation of the surface of the final cast object may be reduced or substantially eliminated as a result of the addition of hexamine to the packing material 7. Surface oxidation also may be reduced by supplying an argon gas bath over the packing material 7. When vacuum 10 is applied, vacuum 10 draws the argon gas down into the packing material 7, displacing any oxygen that may be present.

It is preferred that prior to covering the form 4 with the packing material 7, the pouring basins 5 are temporarily covered with pouring basin caps 11 made of metal or foil to keep the packing material 7 from entering the pouring basins 5. Once the form 4 is buried, a vibrator 8 may be used to pack the packing material 7, e.g., sand. As the vibrator 8 packs the packing material 7, it may become necessary to add additional packing material 7 to ensure that the form 4 is sufficiently covered with the packing material 7. The whole pouring chamber 1 is then covered with a substantially gas-impermeable covering 2 such as a polyethylene blanket. In the case of refractory, gas-permeable, shell-type molds, the pouring basin 5, which has been pre-heated, heats up the pouring basin cap 11 which melts a hole through the covering 2, through which molten metal 6 can be poured. Alternatively, the covering 2 can be cut to expose the pouring basin 5. In the case of foam forms, the membrane 2 must be cut in order to expose the pouring basin 5.

Optionally, sheets of metal or other material 12 may be positioned on top of the covering 2 to serve as splash guards when the molten metal 6 is poured into the pouring basins 5. A quantity of the packing material 7 deposited on top of the covering 2 likewise can serve as a splash guard.

As the molten metal 6 is poured into the pouring basin 5, a vacuum pump is turned on, and air is drawn out via evacuation pipe 3. As a result, the packing material 7 under the flexible membrane 2 becomes very hard as atmospheric pressure pushes down onto the packing material 7 and provides support to the form 4. Also, when the form 4 is a refractory, gas-permeable, shell-type mold, entrapped air is drawn out through the mold walls, making possible the capture of exact detail and close tolerances in the cast object.

In the present invention, the pouring chamber 1 is stationary. Because gravity is used to draw the molten metal 6 into the form 4, after pouring the molten metal 6, the vacuum can be turned off, and ports 9 in the bottom of pouring chamber 1 can be opened to empty packing material 7 and ready pouring chamber 1 for the next casting, in a 3–4 minute total cycle time. The packing material 7 emptied from the pouring chamber 1 may be received in one or more hoppers 13, transported to one or more overhead hoppers 14, returned to pouring chamber 1 and reused in the next casting cycle. The hoppers 13 may be subgrade in that they may be located beneath the pouring chamber 1.

There is no need to leave the vacuum on while the molten metal solidifies, as in the case of the prior art vacuum method, because there is no danger of the molten metal draining out of the refractory, gas-permeable, shell-type mold.

In the case where the form 4 is a refractory, gas-permeable, shell-type mold, the inventive apparatus and method also greatly speed up the making and casting of highly accurate castings. This is because the packing material 7, hardened as it is packed by the vacuum 10, supports the mold during casting thereby preventing mold failure and leaks and prevents mold deformation even with very thin-walled, refractory, gas-permeable, shell-type molds (on the order of 5–8 layers or less).

Another advantage of the inventive apparatus and method is that the vacuum 10 which hardens the packing material 7 which supports the form or forms 4 during casting enables the molten metal to better fill-out the forms 4 providing greater detail and more faithful reproduction in the finished cast objects. In the case where the forms 4 are foam, this is because the vacuum assists in drawing the molten metal 6 into the gaseous cavities created by the vaporization of the foam. In the case where the forms 4 are refractory, gas-permeable, shell-type molds, the vacuum aids in fill out of the molds as a result of the fact that the molds have slight but measurable permeability. This permeability can be used to advantage in the inventive vacuum-assisted casting method. In the inventive method, the vacuum 10 evacuates entrapped air from the mold cavity through the mold walls, thus making possible enhanced fill-out of the mold cavity. The thicker the walls of the mold, the less effective such use of vacuum becomes. Accordingly, the use of thin-walled, refractory, gas-permeable, shell-type molds according to the present invention maximize the benefits of vacuum assist by facilitating evacuation of entrapped air by the vacuum. The thin walls also greatly reduce labor and material cost associated with the manufacture of each mold due to the fact that the mold walls are made of fewer layers and the molds require fewer down sprues and ingates.

With the vacuum-assist method of this invention, non-fill is substantially minimized as a problem. Accordingly, refractory, gas-permeable, shell-type molds can be filled using fewer down sprues and ingates, giving rise to labor savings in mold making as well as in finishing as a result of less cut-off and less surface to retool in the cast object. With the vacuum-assist method of this invention, even large parts can be ganged and poured from a single pouring basin, a practice previously limited to the casting of small objects.

Another advantage of the present invention is that a large pouring chamber can be used without loss of efficiency, even when small castings are being made. This is because there is very little difference in the total process time whether one uses a larger or smaller pouring chamber. This means one can go easily from 12-inch castings to 60-inch castings in the same pouring chamber. The same would hold true if one went from 6-foot castings to 12-foot castings.

Thus it is seen that a vacuum-assisted, gravity-fed casting apparatus and method are provided. One skilled in the art will appreciate that the present invention can be practiced by other than the described embodiments, which are presented for purposes of illustration and not of limitation, and the present invention is limited only by the claims which follow.

What is claimed is:

1. A method of casting molten metal, comprising:

positioning a packing-material-containing overhead hopper above a pouring chamber;

placing at least one form inside said pouring chamber;

transferring said packing material from said overhead hopper to said pouring chamber;

covering said pouring chamber with a gas-impermeable lid;

applying a vacuum to said pouring chamber;

pouring a molten metal through an inlet to said at least one form;

discharging said packing material from said pouring chamber into a receiving hopper that is linked to said overhead hopper; and returning said discharged packing material to said linked overhead hopper for use in a next casting cycle.

2. A method as claimed in claim 1 casting of the molten metal and recycling of said packing material takes place at a single location.

3. A method as claimed in claim 1 further comprising discharging a substantial portion of said packing material from said chamber.

4. A method as claimed in claim 1 further comprising heating at least one of said at least one form before placing it inside said pouring chamber.

5. A method as claimed in claim 1 further comprising vibrating said pouring chamber to pack said packing material around said at least one form.

6. A method as claimed in claim 5 further comprising adding an additional quantity of said packing material to said pouring chamber.

7. A method as claimed in claim 1 further comprising covering said at least one form with a cap before filling said pouring chamber with said packing material.

8. A method as claimed in claim 1 wherein said packing material is sand.

9. A method as claimed in claim 8 wherein said sand is unbonded.

10. A method as claimed in claim 1, wherein the molten metal poured into at least one of said at least one form is selected from the group consisting of ferrous and non-ferrous alloys.

11. A method as claimed in claim 10 wherein the molten metal poured into at least one of said at least one form is selected from the group consisting of steel, aluminum and bronze.

12. A method as claimed in claim 1 wherein said packing material feeder includes a hopper placed above said pouring chamber.

13. A method as claimed in claim 1 wherein said pouring chamber includes one or more ports through which said packing material may be discharged.

14. A method as claimed in claim 1 wherein said pouring chamber includes an evacuation pipe through which said vacuum element is applied to said pouring chamber.

15. A method as claimed in claim 1 wherein said gas-impermeable covering comprises polyethylene.

16. A method as claimed in claim 1 wherein said gas-impermeable covering comprises rubber.

17. A method as claimed in claim 1 wherein said gas-impermeable covering comprises metal.

18. A method as claimed in claim 8 wherein said sand includes at least one additive for reducing decarburization of a cast metal object.

19. A method as claimed in claim 18 wherein said additive is a material selected from the group consisting of hexamine, argon gas and combinations thereof.

20. A method as claimed in claim 8 wherein said sand includes at least one colorant for imparting color to a cast metal object.

21. A method as claimed in claim 1 further comprising pouring the molten metal into said at least one of said at least one form through an inlet attached to said at least one form.

22. A method as claimed in claim 21 wherein each of said at least one forms is connected to a respective pouring basin by one or more passages selected from the group consisting of runners, down sprues and ingates.

23. A method as claimed in claim 1 wherein at least one of said at least one form is made from a wax pattern.

24. A method as claimed in claim 1 wherein at least one of said at least one form is made from a ceramic shell-type mold.

25. A method as claimed in claim 24 wherein said at least one ceramic shell-type mold form is a refractory ceramic shell-type mold.

26. A method as claimed in claim 1 wherein at least one of said at least one form is made from foam.

27. A method as claimed in claim 26 wherein said at least one foam form is coated with about one layer made from a mixture comprised of ceramic slurry and sand.

28. A method as claimed in claim 26 further comprising covering each respective one of said at least one forms with a pouring basin cap.

29. A method as claimed in claim 28 wherein said pouring basin cap comprises foil.

30. A method as claimed in claim 28 wherein said pouring basin cap comprises metal.

31. A method as claimed in claim 1 further comprising a placing a splash guard over said substantially gas-impermeable covering.

32. A method as claimed in claim 31 wherein said splash guard comprises foil.

33. A method as claimed in claim 31 wherein said splash guard comprises metal.

34. A method as claimed in claim 31 wherein said splash guard comprises said packing material.

35. A method as claimed in claim 31 wherein said splash guard comprises sand.

36. A system for casting molten metal, comprising:

an overhead hopper;

a pouring chamber positioned beneath said overhead hopper to receive said packing material from said overhead hopper;

a substantially gas-impermeable lid covering said pouring chamber;

a vacuum element which is applied to said pouring chamber to pack said packing material around at least one form to define a volume devoid of said packing material, said vacuum assisting in the filling with said molten metal of said volume; and a packing material recycler linked to said overhead hopper and positioned relative to said pouring chamber to receive a discharged packing material from said pouring chamber and return said discharged packing material to said overhead hopper for use in a next casting cycle.

37. A system as claimed in claim 36 wherein said packing material feeder, said pouring chamber and said packing material recycler are aligned to enable casting of the molten metal and recycling of said packing material to take place at a single location.

38. A system as claimed in claim 36 wherein substantially all of said packing material is discharged from said pouring chamber and returned to said packing material feeder for use in said subsequent casting cycle.

39. A system as claimed in claim 36 wherein said packing material feeder includes a hopper located above said pouring chamber.

40. A system as claimed in claim 36 wherein said pouring chamber includes one or more ports through which said packing material may be discharged.

41. A system as claimed in claim 36 wherein said pouring chamber includes an evacuation pipe through which said vacuum element is applied to said pouring chamber.

42. A system as claimed in claim 36 wherein said gas-impermeable covering is made from polyethylene.

43. A system as claimed in claim 36 wherein said gas-impermeable covering is made from rubber.

44. A system as claimed in claim 36 wherein said gas-impermeable covering is made from metal.

45. A system as claimed in claim 36 wherein said packing material is sand.

46. A system as claimed in claim 45 wherein said sand is unbonded.

47. A system as claimed in claim 45 wherein said sand includes at least one additive for reducing decarburization of a cast metal object.

48. A system as claimed in claim 47 wherein said additive is a material selected from the group consisting of hexamine, argon gas and combinations thereof.

49. A system as claimed in claim 46 wherein said sand includes at least one colorant for imparting color to a cast metal object.

50. A system as claimed in claim 36 wherein the molten metal is a material selected from the group consisting of ferrous and nonferrous alloys.

51. A system as claimed in claim 50 wherein the molten metal is a material selected from the group consisting of steel, aluminum and bronze.

52. A system as claimed in claim 36 further comprising at least one form placed inside of said pouring chamber to receive the molten metal.

53. A system as claimed in claim 52 further comprising a pouring basin attached to each of said at least one forms through which the molten metal enters a respective one of said at least one forms.

54. A system as claimed in claim 53 wherein each of said at least one forms is connected to a respective pouring basin by one or more passages selected from the group consisting of runners, down sprues and ingates.

55. A system as claimed in claim 52 wherein at least one of said at least one forms is made from a wax pattern.

56. A system as claimed in claim 52 wherein at least one of said at least one forms is made from a ceramic shell-type mold.

57. A system as claimed in claim 55 wherein said at least one of said at least one ceramic shell-type mold forms is a refractory ceramic shell-type mold.

58. A system as claimed in claim 52 wherein at least one of said at least one forms is made from foam.

59. A system as claimed in claim 52 wherein said at least one of said at least one foam forms is coated with about one layer made from a mixture comprised of ceramic slurry and sand.

60. A system as claimed in claim 52 further comprising at least one pouring basin cap for covering a respective one of said at least one forms.

61. A system as claimed in claim 60 wherein said pouring basin cap is made from foil.

62. A system as claimed in claim 60 wherein said pouring basin cap is made from metal.

63. A system as claimed in claim 52 further comprising a splash guard which fits over said substantially gas-impermeable covering.

64. A system as claimed in claim 63 wherein said splash guard is made from foil.

65. A system as claimed in claim 63 wherein said splash guard is made from metal.

66. A system as claimed in claim 63 wherein said splash guard is made from said packing material.

67. A system as claimed in claim 63 wherein said splash guard is made from sand.

* * * * *